United States Patent [19]

Cooper, Jr. et al.

[11] 4,287,798

[45] Sep. 8, 1981

[54] SAWMILL WORK FEEDING AND PRODUCT HANDLING APPARATUS

[76] Inventors: Hill M. Cooper, Jr.; William B. Cooper; Robert M. Cooper, all of P.O. Box 586, Wadley, Ga. 30477

[21] Appl. No.: 117,098

[22] Filed: Jan. 31, 1980

[51] Int. Cl.[3] ..... B27B 7/00

[52] U.S. Cl. ..... 83/155; 83/157; 83/412; 83/425.2; 83/433; 83/435.1; 83/708

[58] Field of Search ..... 83/412, 433, 435.1, 83/437, 703, 704, 706, 708, 710, 711, 425.2, 155, 157

[56] References Cited

U.S. PATENT DOCUMENTS

| | | | |
|---|---|---|---|
| 3,747,455 | 7/1973 | Hartzell et al. | 83/435.1 X |
| 3,786,712 | 1/1974 | Mackin | 83/435.1 X |
| 4,117,755 | 10/1978 | Hasenwinkle et al. | 83/435.1 |
| 4,147,259 | 4/1979 | Nilsson | 83/435.1 X |
| 4,177,704 | 12/1979 | Randle | 83/435.1 |

*Primary Examiner*—Frank T. Yost

*Attorney, Agent, or Firm*—Newton, Hopkins & Ormsby

[57] ABSTRACT

Opposed parallel supporting rollers of a log receiving and turning assembly are rotated in order to rotate the log received thereon. The rollers are carried by a frame which is lifted or lowered, as desired, and a bar between the rollers is tiltable so as to lift selectively one end of the log or the other. By such an arrangement, the log is oriented so that a pair of dogs engage the log from opposite ends. These dogs are carried by an overhead carriage assemblies which ride on tracks and are movable with respect to each other by means of a hydraulic cylinder. One dog is rotatable by a motor through 90° so as to orient the log. The carriage assemblies are movable in a longitudinal direction so that a pair of saws, driven by motors, will simultaneously cut the logs on opposite sides so as to deposit the boards, when cut from the log, on respective conveyors which carry the boards longitudinally away from the saws. The saws are adjustable laterally for different widths of log. The conveyors pivot for selective feeding to one or the other of parallel discharge conveyors. The cant is discharged by a central conveyor.

19 Claims, 9 Drawing Figures

SAWMILL WORK FEEDING AND PRODUCT HANDLING APPARATUS

BACKGROUND OF THE INVENTION

1. Field of the Invention

This invention relates to a sawmill and is more particularly concerned with a device for automatically supporting and feeding a log to the saws of a sawmill.

2. Background of the Invention

In the past, automatic sawmills have been devised which feed the logs to a opposed blades which simultaneously slice boards from opposite sides of the log as the log is reciprocated in a suspended condition carried by dogs which hold the logs at opposite ends. Such prior art machines have also rotated the logs through 90° and, indeed, through 360° so that the boards may be cut from the logs, as the operator sees fit.

The applicant is aware of the following U.S. Pat. Nos. relating to such prior art machines: 3,835,978, 3,747,455, 3,872,758, and 3,889,556.

Furthermore, machines having the same board discharge assembly, the same saw assembly and the same log lifting and turning assembly have been used and sold more than one year prior to this application.

SUMMARY OF THE INVENTION

Briefly described, the present invention includes a frame structure having opposed horizontal channel members which confine the longitudinally and transversely spaced wheels of a main carriage assembly for traveling in a longitudinal direction. Connected to the carriage assembly is a hydraulic cylinder, the piston of which is connected to an auxiliary carriage assembly having a pair of wheels on opposite sides which ride in the opposed channel members. Rearwardly of the opposed wheels of the auxiliary carriage assembly is a single upstanding central wheel carried between a pair of upstanding brackets. A pair of spaced, opposed guide rollers, are received on opposite sides of the web of an I beam, the rollers riding along a V-shaped track protruding from the lower surface of the lower flange of the I beam. The main carriage assembly carries a motor which rotates one of the dogs and the auxiliary carriage assembly carries the other dog which is freely rotatable.

In the forward position of the machine below the retracted position of the main carriage assembly is a log lifting and turning assembly which raises and lowers a log, rotates the log and lifts one end or the other of the log so as to align one or both ends of the log for being clamped between the dogs by actuation of the cylinder. The carriage assembly is moved longitudinally by means of cables driven from a drum which is driven by a reversible motor.

When suspended between the dogs and moved forwardly, the log is carried between opposed circular saws of a saw assembly which, upon reciprocation of the log, progressively cuts opposite sides of log to provide slabs and then boards from the log, leaving the central cant which is dropped onto a central conveyor. The slabs and the boards are fed by outer conveyors selectively to a slab conveyor or to the board conveyor.

Accordingly, it is an object of the present invention to provide a sawmill which will receive successive logs, firmly clamp them by their ends and reciprocate each log along a linear path for cutting action of a saw or saws.

Another object of the present invention is to provide a sawmill which is inexpensive to manufacture, durable in structure and efficient in operation.

Another object of the present invention is to provide a sawmill which will automatically handle the cutting of a log into boards.

Another object of the present invention is to provide a sawmill which is readily and easily repaired.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1A:
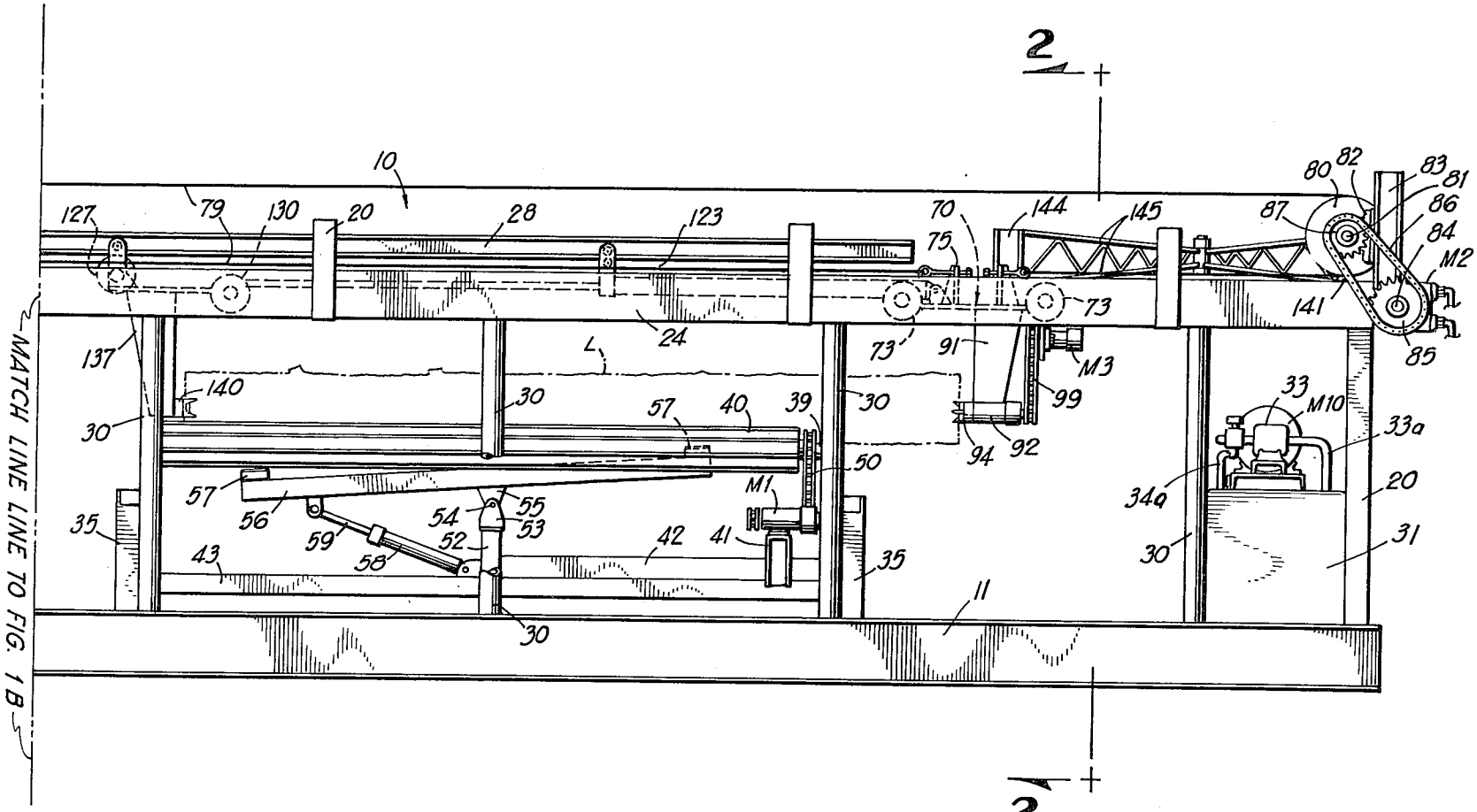
FIG. 1A is a side elevational view of a portion of a sawmill constructed in accordance with the present invention.

Referring now in detail to the embodiment chosen for the purpose of illustrating the present invention, it being understood that in its broad aspects, the present invention is not limited to the exact details herein depicted, numeral 10 denotes generally an open, elongated, rectangular, main frame which includes a pair of spaced, parallel, longitudinally extending, "I" beams 11 which extend throughout the length of the machine. A plurality of longitudinally spaced, transversely disposed, parallel cross-beams 13 join the "I" beams 11 to form a rigid base. The "I" beams 11 and 13 are mounted with their webs upright, the "I" beams 13 being narrower than the "I" beams 11 as seen best in FIGS. 2 and 3.

Extending over and secured to the forwardmost transverse beams 13 are a pair of longitudinally extending, opposed, parallel, support "I" beams 15. The "I" beams 15 support the log lifting and turning assembly, seen best in FIG. 4. An "I" beam 16, shown in FIG. 3, extends longitudinally along the centerline of the frame, rearwardly of the "I" beams 15.

Mounted on the "I" beams 11 are the longitudinally and transversely spaced, upstanding, "I" beam struts 20. Opposed pairs of the struts 20 support the transversely extending, upper support beams 21. Fillets 22 reinforce the inverted U-shaped frames which are formed by the struts 20 and beam 21.

Figure 2:
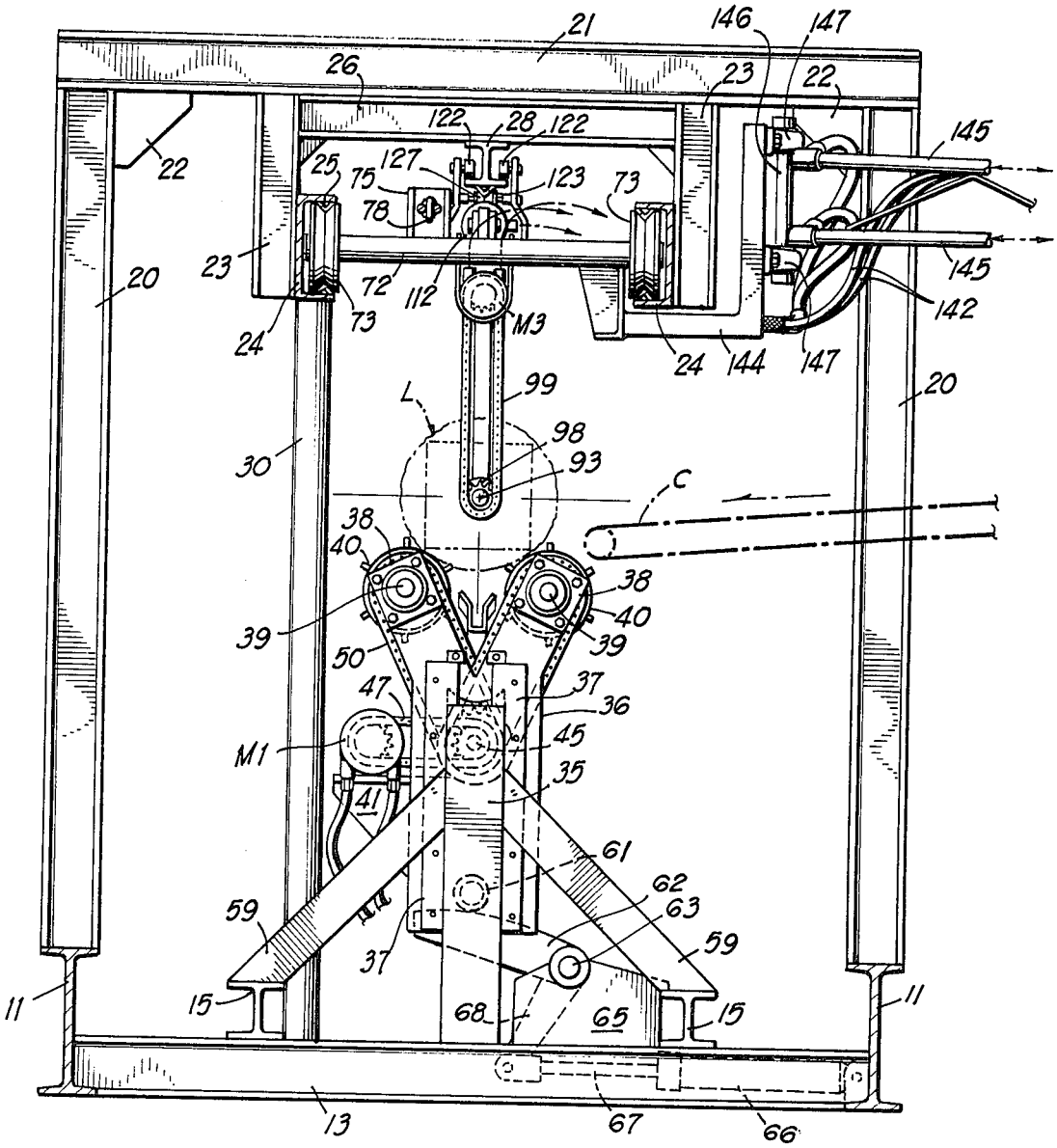
FIG. 2 is a cross-sectional view taken substantially along line 2—2 in FIG. 1A.
Figure 3:
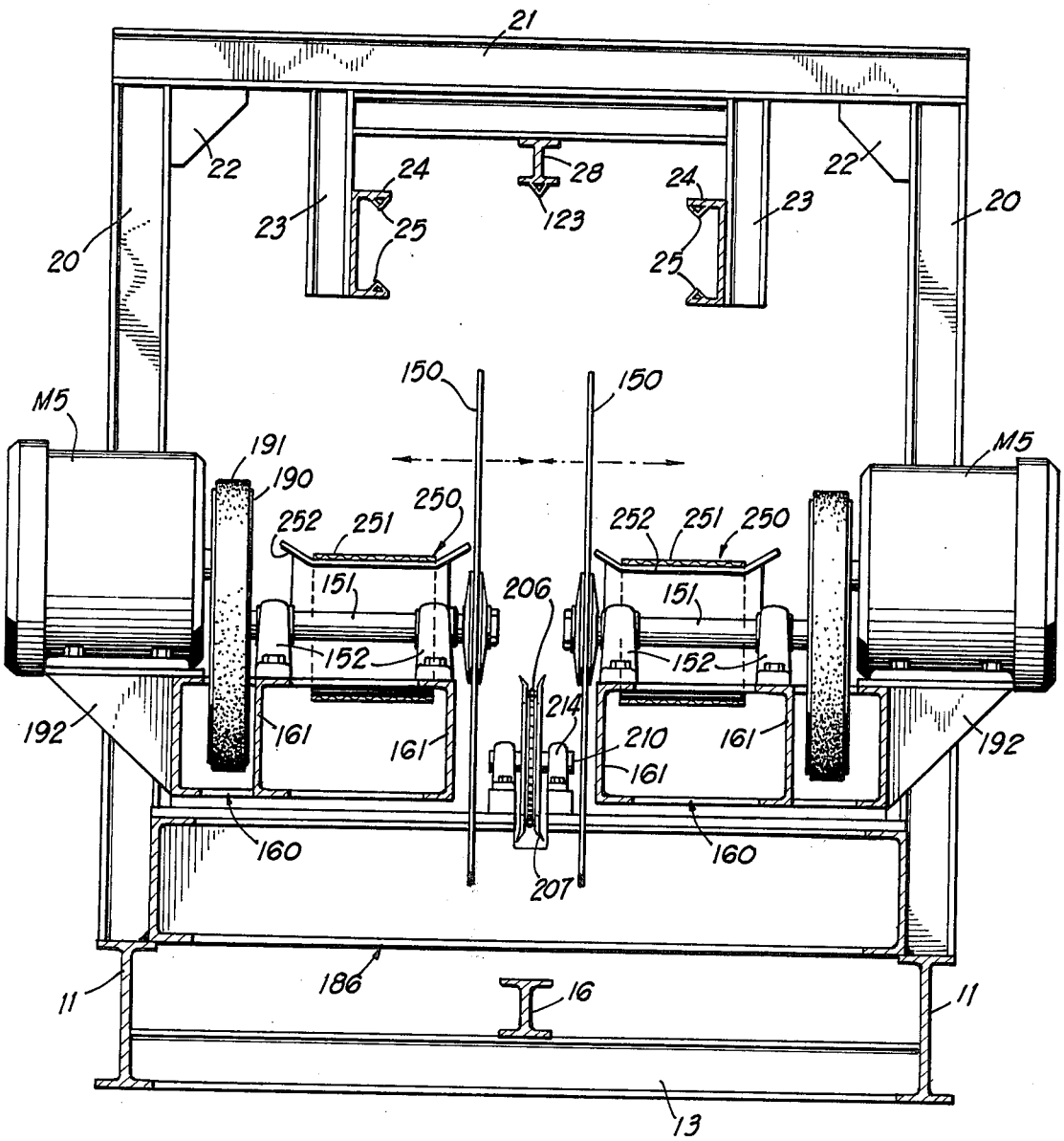
FIG. 3 is a cross-sectional view taken substantially line 3—3 in FIG. 1B.

As seen in FIGS. 2 and 3, the forward group of upper beams 21 are respectively provided with transversely opposed spaced pairs of longitudinally spaced and aligned downwardly protruding braces 23, the inner surfaces of which carry a pair of opposed, parallel, facing, longitudinally extending, horizontally disposed, channel member tracks 24 which extend from essentially the front of the machine, rearwardly throughout the length of the frame 10. The inner surfaces of the upper and lower ledges or flanges of the opposed tracks 24 are provided with angle irons which form vertically aligned pairs of opposed inwardly protruding V-shaped guides 25.

Extending between the opposed pairs of braces 23 and secured to the bottoms of beams 21 are cross bars 26, the function of which is to carry in a horizontally longitudinally extending monorail or central track 28 which is an "I" beam with its web disposed vertically. The upper flange of the "I" beam 28 is secured to the lower central portion of the crossbars 26 so that the lower flanges of the "I" beam forms laterally extending flanges defining an unobstructed track throughout its length from a position inwardly of the front of frame 10 to the rear end portion of the frame 10. Longitudinally spaced, upstanding posts 30, which are inwardly of the struts 20, support the outer track 24 as seen in FIG. 1A and FIG. 2.

Within the forward portion of the main frame 10 is the hydraulic system including a hydraulic fluid reservoir tank 31, seen in FIG. 1A, on which is mounted an electric motor M10 which drives a hydraulic pump 33, the pump 33 taking a suction from the hydraulic reservoir tank 31 through a pipe 33*a* and delivering hydraulic fluid to a pressure control valve 34, the excess hydraulic fluid being delivered back to tank 31 through a return pipe 34*a*. The various hydraulic lines which are discussed hereinafter receive fluid from the pump 33 through appropriate remote control valves (not shown).

Figure 4:
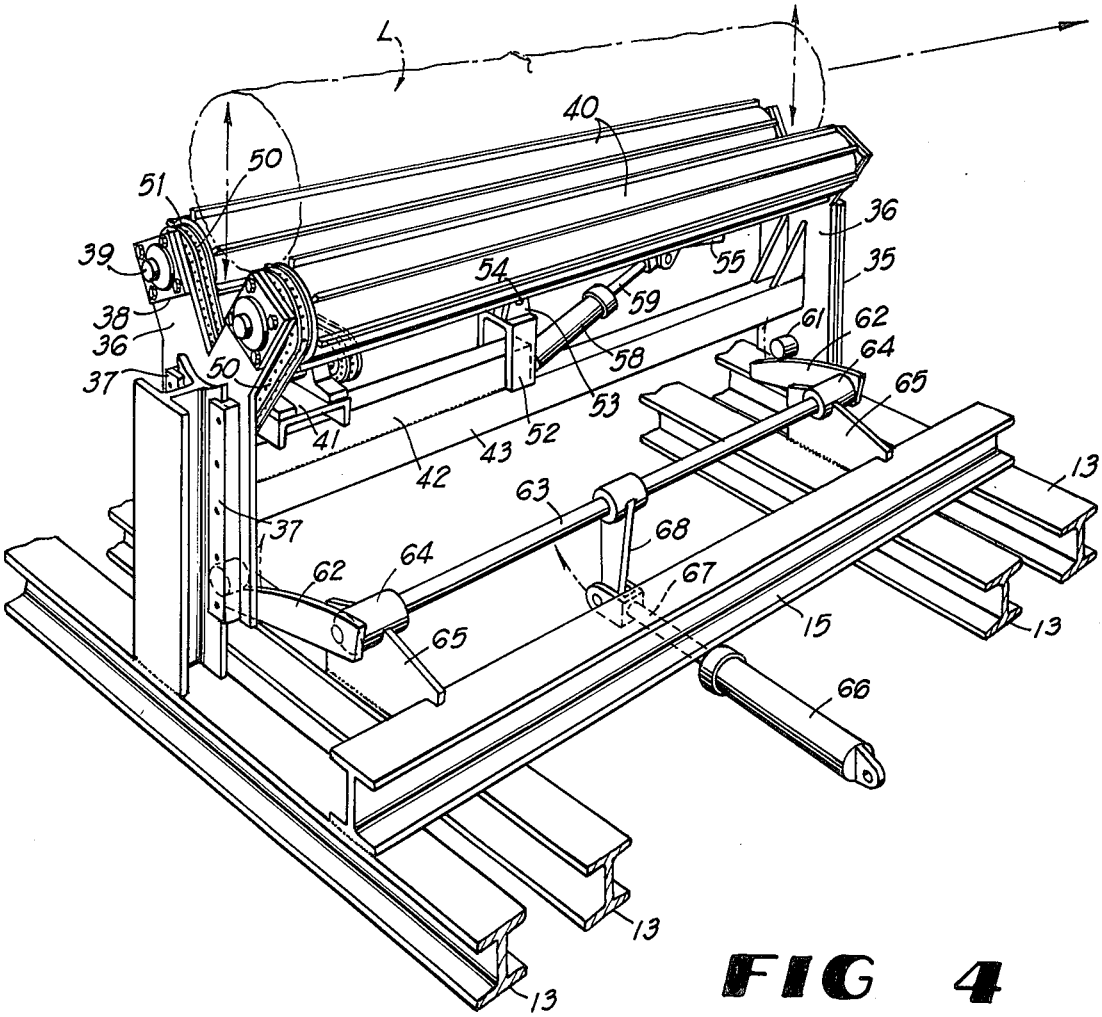
FIG. 4 is a fragmentary prospective view of the log receiving and positioning assembly of the sawmill depicted in FIG. 1A.
Figure 5:
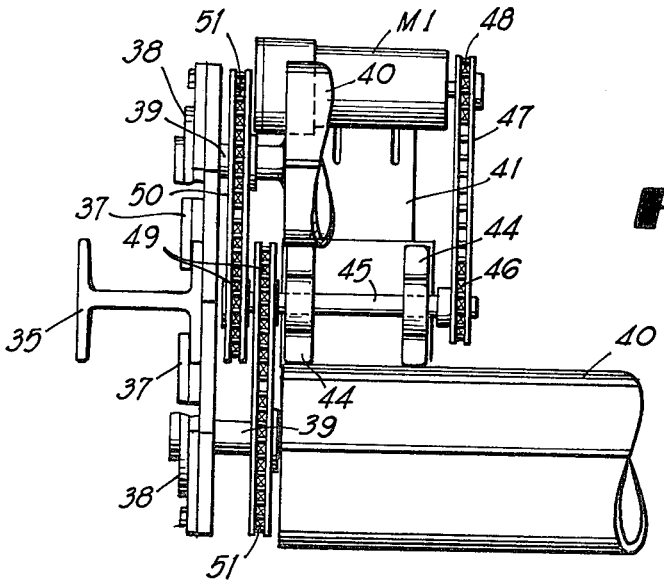
FIG. 5 is a fragmentary top plan view of a portion of the assembly depicted in FIG. 4.

As best in seen in FIGS. 2, 4 and 5, the frame 10 receives therein, rearwardly of the hydraulic system, a log receiving and turning assembly, the function of which is to receive successive logs L and position them in appropriate positions to be clamped by their ends between a pair of dogs 94 and 140 so that the log L may, thereafter, be suspended and carried, therebetween, rearwardly and then forwardly in a longitudinal linear path. This log receiving and turning assembly includes a pair of upstanding longitudinally aligned, centrally disposed, guide brackets 35 which are mounted at the center portion of a pair of the cross beams 13. A pair of opposed, upstanding, Y-shaped, roller supporting, slide plates 36 are disposed inwardly of the inner flanges of the brackets 35, the slide plates 36 having opposed pairs of vertically disposed L-shaped guide members 37 which are secured to the outer surfaces of the slide plates 36 so that the opposed pair of guide members 37 on each of the slide plates 36 encompass the edge portions of the inner flanges of the associated bracket 35 to permit vertical sliding of the slide plate 36 along the length of the upstanding bracket 35.

It will be understood that the upper end of each slide plate 36 is bifurcated, having a pair of diverging legs which respectively carry at their outer and upper end portions, pillow blocks 38 which journal shafts 39 on the end portions of these legs. The shafts 39 support a pair of longitudinally extending, transversely spaced, parallel, longitudinally spined, rollers 40 which are longer than the average length of a log L and are spaced apart by a distance less than the diameter of the smallest typical log L so as to cradle the log L between the rollers 40 and thereby roll the log L in one direction or the other when the rollers 40 are rotated simultaneously in one direction or the other.

For driving the rollers 40 a hydraulic motor M-1, seen in FIGS. 1A, 2 and 4, supplied with hydraulic fluid from pump 33 through controls (not shown) is carried by a sidewise extending bracket 41 on a longitudinally extending bar 42 mounted on a longer, longitudinally extending, bar 43 fixed between the slide plates 36 for movement therewith. This bracket 41 also supports a pair of pillow blocks 44 which journal a power transfer shaft 45, the shaft 45 being driven by a sprocket 46 around which a chain 47 extends, the chain 47 also extending around a sprocket 48 on the motor M1. Shaft 45 drives a pair of sprockets 49 which respectively drive chains 50 for driving sprockets 51 connected respectively to the shafts 39. Thus, rollers 40 are selectively rotated in one direction or the other, in synchronization, by motor M1. This causes rotation of log L clockwise or counter clockwise on rollers 40.

The rear end portion of the bar 42 as seen in FIGS. 1A and 4 is provided with a fixed, inverted, U-shaped, upstanding strap 52, on which is mounted a pair of upstanding transversely opposed brackets 53, between which are supported a transverse pivot pin 54, the pivot pin 54 receiving a central downwardly extending mounting bracket 55 mounted on the lower central portion of a central, longitudinally extending, tilt or rocker arm 56. The ends of the tilt arm 56 are provided with upwardly diverging flanges 57. Pivotally mounted on the rear end of the bar 42 is a double acting hydraulic cylinder 58 having a piston rod 59, the end of rod 59 being pivotally connected to one end portion of the tilt arm 56. By manipulation of the hydraulic fluid to cylinder 58, the tilt arm 56 may be rocked, as desired, so that the upstanding flanges 57 move upwardly and downwardly between the rolls 40 for contacting the bottom periphery at one end portion or the other of the log L so as to lift, incrementally and selectively, one end portion or the other of the log L off of the rollers 40.

It will be understood that an infeed conveyor C, shown in broken lines in FIG. 2, feeds successive logs L to the rolls 40 so that a log L is supported in a central position extending longitudinally along the centerline of the frame 10, as shown by broken lines in FIGS. 1A, 2 and 4. Reinforcing struts 59 arrest lateral movement of the upstanding guide member 35.

For raising and lowering the rollers 40, the guide-plates 36, is provided with a pair of longitudinally aligned, inwardly protruding, pins 61 which ride upon the upper camming surfaces of a pair of sidewise extending lifting levers 62, mounted on opposite ends of a common longitudinally extending shaft 63, all seen in FIG. 4. The shaft 63 is journalled by bearings 64 carried by upstanding plates 65, which, in turn, are mounted upon the cross beams 13 and one of the longitudinally extending beams 15. A hydraulic cylinder 66 has a piston rod 67, the end portion of which is pivotally connected to a downwardly extending lever arm 68 which is fixed to the shaft 63. The extension of the piston rod 67 will cause rotation of the shaft 63 so that the levers 62 lift the pins 61 and thereby lift the plates 36 to raise the rollers 40. When the piston rod 67 is released or returned, the shaft 63 is rotated so as to lower the levers 62 and thereby lower the slide plates 36 and the rollers 40. Therefore, when a log L is received on the rollers 40, the log L may be raised or lowered by manipulation of hydraulic fluid to the cylinder 66 through a control (not shown) and the log L may be rotated in one direction or the other by actuation of motor M1. Also lever 56 will lift one end or the other of log L.

Above the log receiving and turning assembly is the log carrying assembly, the function of which is to support dogs 94 and 140 for clamping the log L for movement in a longitudinal path and for rotation through 90° so that the outer portions of the log L can be progressively cut by the saw assembly. The log carrying assembly includes a main carriage assembly, denoted generally by the numeral 70. This main carriage assembly includes a flat rectangular, horizontally disposed, carriage plate 71 provided at both ends with parallel, transversely extending shafts 69, the end portions of which protrude beyond the side edges of the plate 71. The shafts 69 are secured, as by welding, to the ends of the plate 71 and are, therefore, firmly affixed thereto. The end portion of the shafts 69 carry respectively for four transversely and longitudinally spaced circumferenctially grooved wheels 73, each of which has a periphery with a V-shaped groove 74 therein. The forwardmost pair of wheels 73 have a common transverse axis and the rear pair of wheels 73 have another common transverse axis. Furthermore, the shafts 72 are parallel to each other, generally in the horizontal plane of plate 71.

A pair of wheels 73 on one side of the main carriage assembly 70 is received in one of the tracks 24 while the other pair of wheels 73 on the other side thereof are received in the other pair of tracks 24. As pointed out above the guides 25 are vertically aligned and the distance between the apexes of these vertically aligned guides 25 is slightly greater than the minimum diameter of the grooves of the wheels. Therefore, the guides 25 receive the upper and lower peripheries of wheels 73 and arrest any appreciable lateral movement of the wheels 73 while permitting free rotation thereof as the carriage assembly 70 moves along a longitudinal path defined by the opposed channel shaped tracks 24.

On the upper surface of the plate 71 are a pair of upstanding, longitudinally aligned, spaced, parallel, complimentary cable receiving brackets 75 which respectively receive eye bolts 76. The bolts 76 are externally threaded and have hexagonal heads. Each bolt is provided with a pair of lock nuts 77 which are on opposite sides of the plate of its bracket 75 through which the bolt extends. Thus, the position of the bolt 76 may be altered incremently, as desired. The outer end of each bolt 76 is provided with an eyelet 78 which receives, looped therein, the end of a cable 79. One portion of cable 79 extends forwardly, being wrapped around a drum 80 disposed for rotation at the foward portion of the machine, as shown in FIG. 1A. The drum 80 is carried for rotation on and with a shaft 81 journalled by pillow blocks 82 on an upstanding mount 83. A hydraulic motor M2 selectively rotates in one direction or the other a shaft 84 which carries a sprocket 85 for driving a continuously chain 86 looped around a sprocket 87 on the shaft 81. Thus the motor M2 controls the rotation of drum 80 to thereby control the take up or pay out of the cable 79. The other end of the cable 79 extends over frame 10 rearwardly and loops around a sheave 90 carried by a shaft 91, journalled on pillow blocks 92 which, in turn, are mounted on a mounting block 93 at the rear end portion of the frame 10. The cable 79, thence, passes forwardly to be received by the eyelet 78 of the rear bolt 77. By supplying hydraulic fluid from pump M10 to the motor M2 through a control valve (not shown), the main carriage assembly 70 will be caused to traverse the length of the tracks 24 in a linear path.

Figure 6:
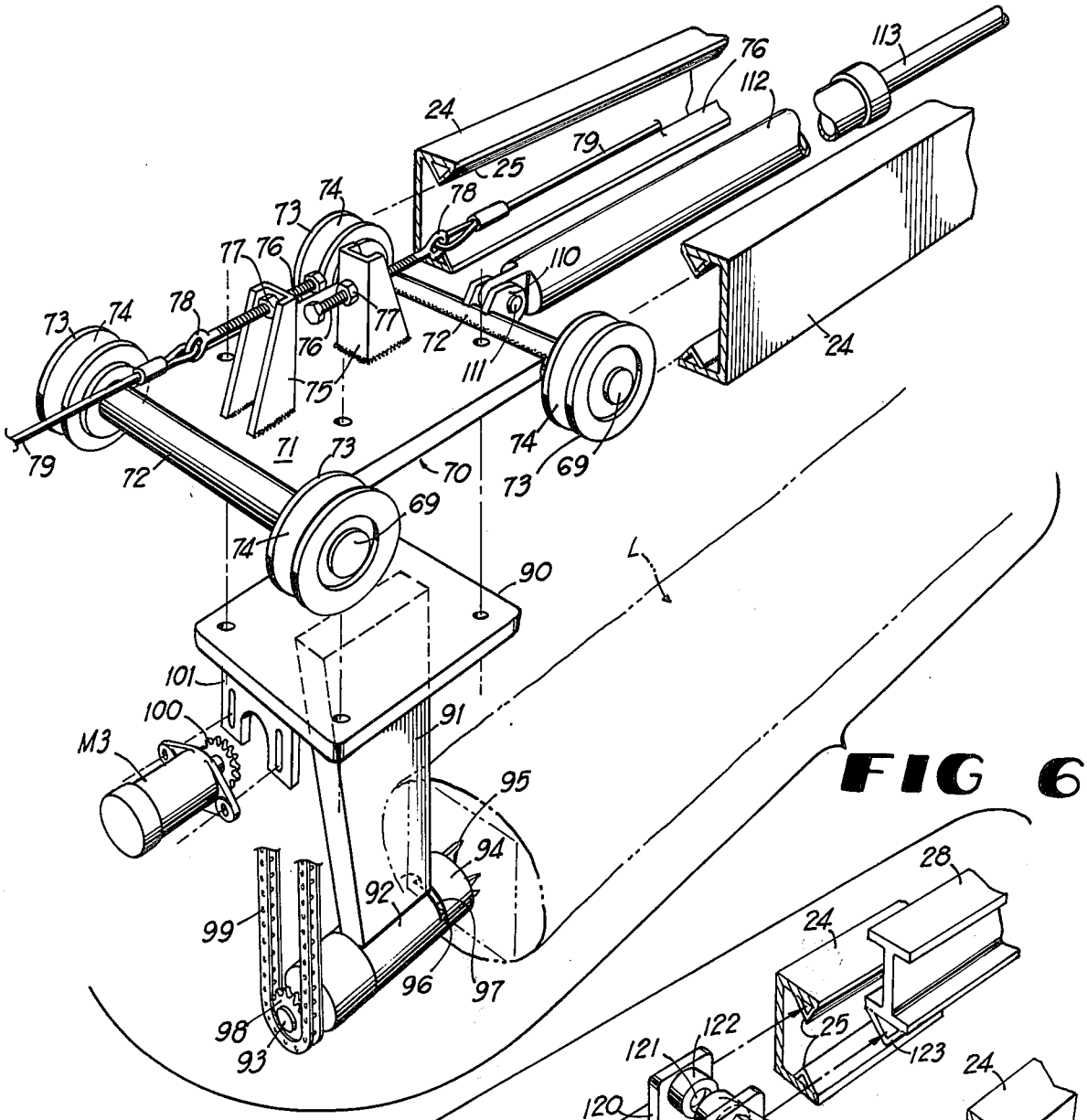
FIG. 6 is an exploded fragmentary prospective view of the rail and main carriage assembly of the sawmill depicted in FIG. 1 and FIG. 1B.

Mounted by means of bolts (not shown) to the bottom surface of the plate 71 is a flat rectangular base 90, best seen in FIG. 6, the base 90 having depending from the central portion thereof, a flat, generally triangular, dog supporting arm 91. The lower end portion of the dog supporting arm 91 is provided with a bearing housing 92 within which are the bearings (not shown) which support, for rotation, a longitudinally extending shaft 93 which protrudes forwardly and rearwardly from the ends of housing 92. The rear end portion of the shaft 93 carries a cylindrical dog 94 which is approximately the same diameter as that of diameter of the housing 92, the dog 94 having a flat radial face provided with forwardly extending and circumferentially spaced prongs or teeth 95 which engage and protrude into the central portion of one end of the log L when the log L is appropriately carried by the log carrying assembly. An arm 96, which protrudes from the shaft 93 radially through a radial slot 97 in housing 92, limits the rotation of the shaft 93 to 90°.

The forward end portion of the shaft 93 is provided with a sprocket 98 around which passes a continuous chain 99. The other end of the chain 99 passes around a sprocket 100 carried on the end of a shaft of a hydraulic motor M3 which, in turn, is mounted on downwardly protruding bracket 101 which is mounted to the bottom surface of the base 90, forwardly of the arm 91. Thus, through manipulation of a control (not shown), the hydraulic fluid from pump M10 to the motor M3, will selectively rotate dog 94 between a 0° position and a 90° rotated position for rotating log L from an original supported position to a rotated position.

Figure 7:
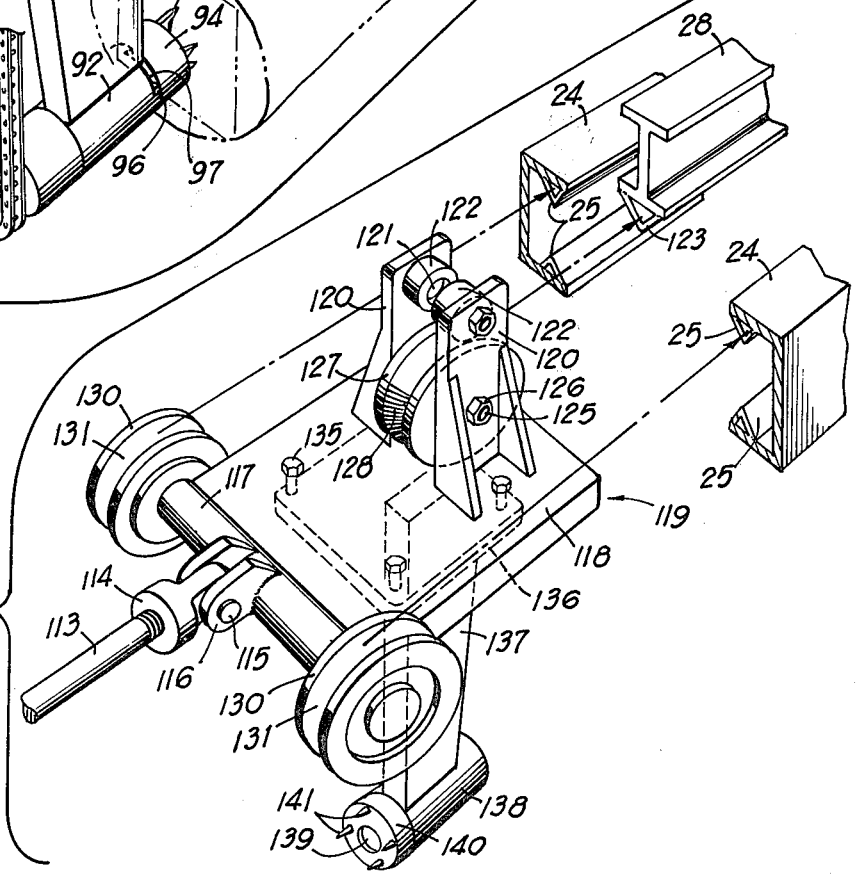
FIG. 7 is a fragmentary prospective view of the auxiliary carriage assembly of the sawmill depicted in FIG. 1A and FIG. 1B.

As best seen in FIG. 6, the rear transverse shaft 72 of the main carriage assembly 70 is provided with a pair of rearwardly extending brackets 110 having a transverse pin which pivotally carries one end of a central, axially extending, double acting hydraulic cylinder 112, the piston rod 113 of which is threadedly received by its outer end in an eye link 114, the link 114 being pivotally retained by a transverse pivot pin 115 carried by a pair of forwardly extending brackets 116. The brackets 116 are mounted on the central portion of a transverse wheel shaft 117, the rear periphery of which is fixed to the forward end of a carriage plate 118 of the rear or auxiliary carriage assembly 119, seen in FIG. 7. The carriage plate 118 is a flat horizontally disposed, essentially square or rectangular member having a pair of upstanding, opposed, transversely aligned, suspension brackets 120 the upper end portions of which respectively carry spaced, opposed, inwardly protruding, stub shafts 121 which, in turn, respectively carry upper rollers 122. Rollers 122 are spaced from each other and rotate about a common transverse axis so that the rollers 122 are adapted to ride upon the upper surface of the lower horizontal flange of the monorail "I" beam 28. The lower surface of this lower flange of the "I" beam 28 is provided with a longitudinally extending angle iron forming a "V" guide member 123, the flanges of which converge downwardly, as shown in FIGS. 2 and 7.

Below the rollers 122 is a transverse bolt 125 having an external nut 126 thereon, the bolt 125 passing through transversely aligned holes in the brackets 120 so as to support for rotation, therebetween, a roller 127 which has a central V-shaped groove 128. The upper periphery of the V-shaped groove 128 receives the guide member 123 so that any appreciable lateral movement of the rear or auxiliary carriage 119 is precluded. Through manipulation of the fluid from motor M10 through controls (not shown) to hydraulic cylinder 112, the auxiliary carriage 119 may be drawn toward or pushed away from the main carriage 70 by extension and retraction of piston rod 113.

The shaft 117 is provided with wheels 130 which are identical to the wheels 73 and include the central V-shaped groove 131. This groove 131 is received on the guides 25 as the wheels 130 ride in the rails 24. Thus, the rear or auxiliary carriage assembly 119 is totally suspended by the overhead monorail 28 and by the side rails 24.

Mounted by bolts 135 to the bottom surface of the plate 118 is a flat rectangular or square mounting plate 136 A generally triangular dog carrying arm 137 is mounted in a perpendicular or vertical position by its upper end to the central portion of the base 136 and protrudes or depends downwardly, therefrom. The lower end of arm 137 carries a cylindrical bearing housing 138 within which is journalled, by bearings (not shown) a central longitudinally extending shaft 139, the axis of which is longitudinally aligned with the axis of shaft 93. The front end portion of this shaft 139 carries the disc shaped dog 140, having a flat radial face and forwardly protruding circumferentially spaced teeth 141. The disc 140 is freely rotatable. The dog or disc 140 is rearwardly of the wheels 130 and forwardly of the wheel 127 and the rollers 122. As such, a major portion of its weight is suspended from the monorail 28 by rollers 22 and a minor portion from the side rails 24 by the wheels 130.

It will be seen that the axes of piston rod 113 and shaft 117 are in the common plane of the plates 71 and 118 which is below the axis of wheels 122. The force, therefore, of piston rod 113 is at about the centroid of rotation with respect to the axis of rollers 122. Also, when the auxiliary carriage 119 is moved forwardly for the teeth 141 of the rear dog 140 to engage and project into the rear end of the log L, the pulling action of the piston rod 113 is transversely distributed evenly between the lower peripheries of the wheels 130 and is also distributed to the rollers 122.

When the rear dog 140 engages log L, it tends to pivot the plate 118 about the pivot pin 115 so that the outer periphery of the roller 127 along its central groove 128 engages the surfaces of the guide 123 for centering the auxiliary assembly 119 so that it may be more readily pulled by the piston rod 113.

When the roller or wheel 127 becomes worn, it can be readily replaced without the necessity of disassembling the other elements of the sawmill. The wheel 127 may be replaced by removing the nut 126, removing the bolt or pin 125 and sliding the pin out. Roller 127 normally carries no weight, whatsoever, and can be replaced quite readily. Furthermore, the rollers 122 are also readily replaceable and can be removed without disassembly of other parts of the structure. Therefore, when such rollers 122 have worn they can be readily replaced by an unskilled laborer.

Figure 1B:
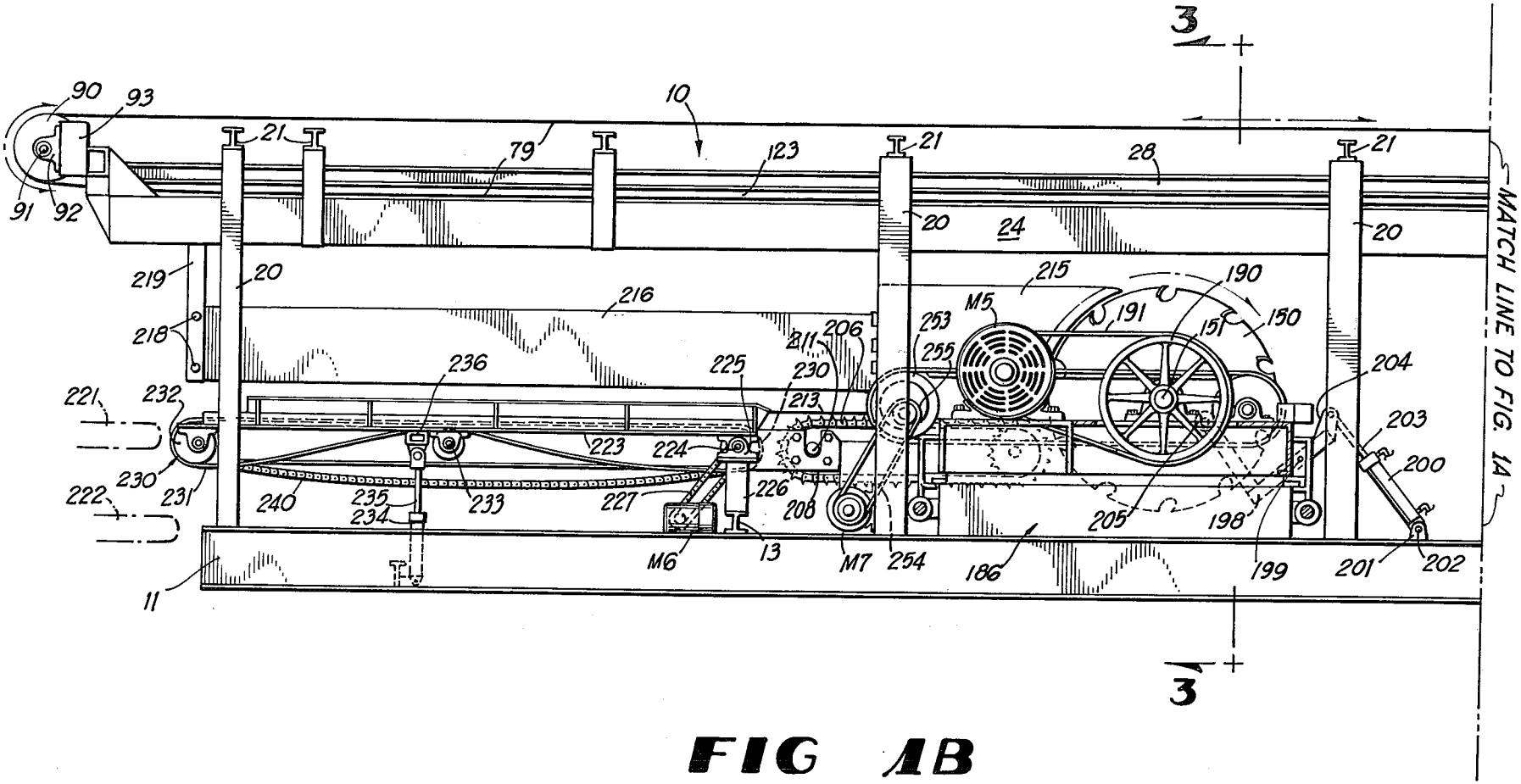
FIG. 1B is a side elevational view of another portion of the sawmill depicted in FIG. 1A.
Figure 8:
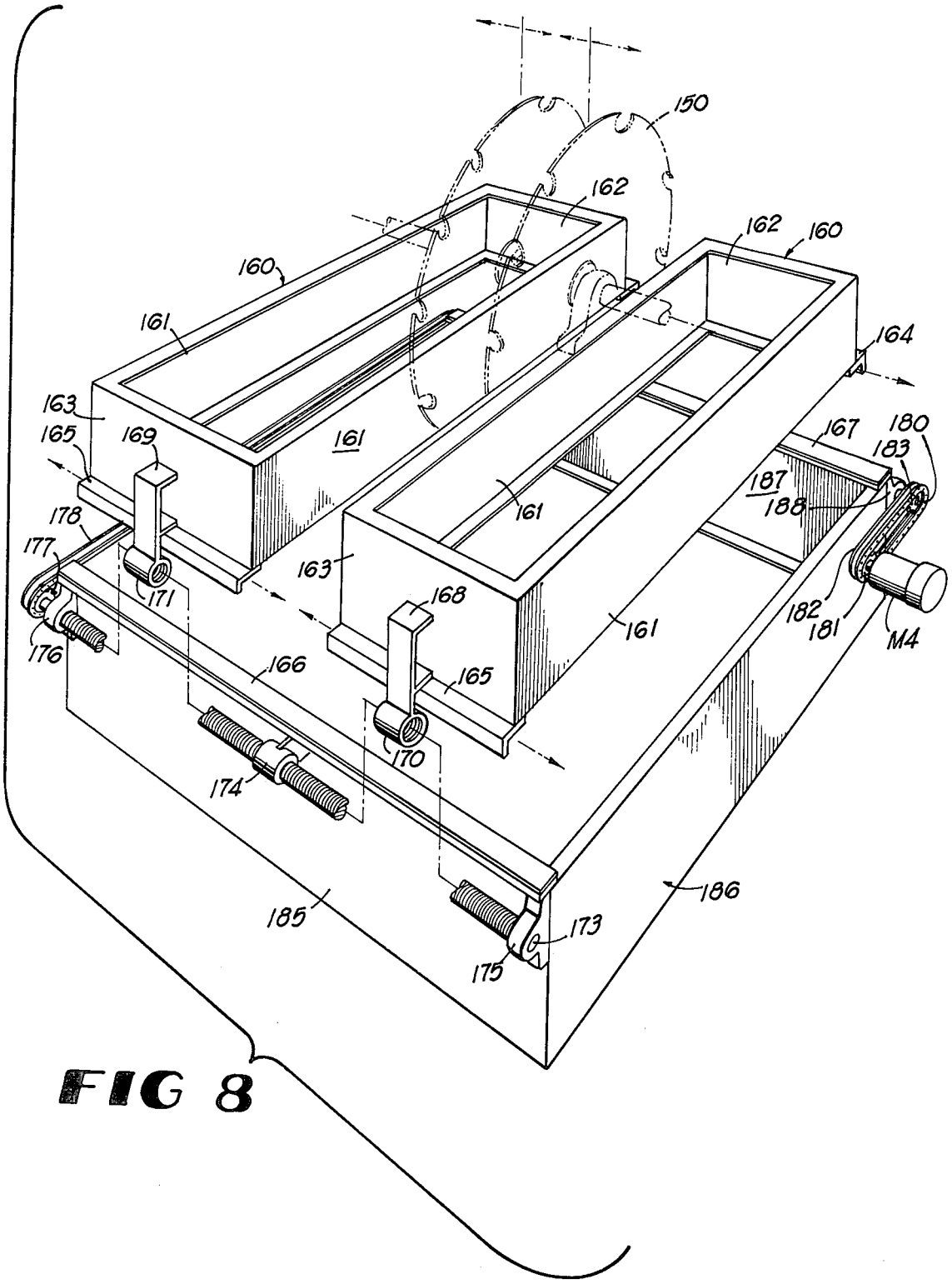
FIG. 8 is an exploded fragmentary prospective view of the saw and discharge conveyor framework.

The hydraulic lines 142 which supply fluid to the motor M3 and the hydraulic lines 143 which supply hydraulic fluid to cylinder 112 are carried by an L-shaped bracket 144 carried by the main carriage assembly 70, seen in FIG. 2. Hoses 143 connect to pipes 145, the ends of which are fixed to and carried by a pivot pin 146 supported by pillow blocks 147 on bracket 144. outwardly adjacent braces 23. In FIG. 1A it is seen that the pipes pivotally connect through a pivotal connector 148 to pipes 149 extend in cantilever fashion from a pivot 141 on frame 10. As best seen in FIGS. 1B, 3 and 8, rearwardly of the log receiving and turning assembly, there is a saw assembly having a saw box which includes a pair of spaced opposed laterally movable circular saw blades 150 mounted on the inner end portions of a pair of spaced, opposed, transversely aligned saw shafts 151. These saw shafts 151 are respectively journalled by pillow blocks 152 which, in turn, are mounted on the rear portions of the opposed upstanding longitudinal walls 161 of the opposed pair of laterally movable saw positioning frames, denoted generally by the numeral 160. These frames 160 include these spaced, parallel upstanding longitudinaly walls 161, the ends of which are joined by the transverse rear end wall 162 and the front end wall 163. The lower edge portions of the end walls 162 and 163 are provided with L-shaped slide brackets 164 and 165 which ride on a pair of transversely extending flat rectangular spaced parallel slide bars 166 and 167, respectively. Brackets, such as brackets 168 and 169, protrude forwardly and downwardly from the front ends 163 and from the rear ends 162, respectively, and each bracket carries an internally threaded sleeves, such as sleeves 170 and 171. The sleeves 170 which are connected to the bracket 168 have left hand threads and the sleeves 171 have a right hand thread. The forward sleeves 170 and 171 are received on a common forward transverse shaft 173 which is journalled by a central bearing 174 and a pair of end pillow blocks 175 and 176. The portion of the shaft 173 between bearing 174 and pillow block 175 is provided with a left hand thread to receive the left hand threaded sleeve 170 while the portion of the shaft 173 which is between the bearing 174 and the pillow block 176 is provided with a right hand thread to receive the sleeve 171. The shaft 173 extends externally of the pillow block 176 and is provided with a sprocket 177, around which extends a continuous chain 178 which is driven by a sprocket (not shown) on the end of a shaft 180. Shaft 180 receives the other two sleeves 170 and 171 and are threaded in the manner that shaft 173 is threaded. Thus, the shafts 173 and 180 rotate in synchronization and, upon rotation of the shaft in one direction, the frames 160 will be moved simultaneously outwardly, away from each other, and, when the shafts 173 and 180 are rotated in the opposite direction, the frames 160 will be moved toward each other. A motor M4 drives a sprocket 181 which in turn drives a continuous chain 182 which extends around and drives a sprocket 183 on the end of the shaft 180. This motor M4 is also a hydraulic motor which can be selectively driven in one direction or the other by fluid from pump 33 through appropriate hydraulic lines (not shown).

The bearing 174 and the pillow blocks 175 and 176 are mounted on a front wall 185 of a rectangular upstanding subframe, denoted generally by the numeral 186. The slide bars 166 are mounted above the pillow blocks 175, 176 and the bearing 174 on the wall 185, as seen in FIG. 8. The rear wall 187 which is parallel to and spaced from the front wall 185 carried the pillow blocks, such as pillow block 188 which support the rear transverse shaft 180. The slide bar 176 is mounted above the pillow blocks such as pillow block 188.

The saw shafts 151 are respectively provided with sheeves 190 which receive drive belts 191 from sheeves (not shown) on the shafts of motors M5. The motors, in turn, are mounted on motor mounting brackets 192 on the respective outer side walls 161 of the frames 160. Thus, the motors M5 ride with the saws 150 as they are carried laterally inwardly and outwardly by the frames 160. The subframe 186 is anchored to the cross beams 13.

Pivotally mounted on the saw subframe 186 at the forward portion thereof is an L-shaped belt crank 198, one arm of which is pivotally mounted by a transversely extending pivot pin 199 on the stationary saw subframe 186. The outer end portion of the pivoted arm of the belt crank 198 is provided with an angularlly disposed extension 204 which is pivotally connected to the distal end of a piston rod 203 of a double acting hydraulic cylinder 200, the cylinder 200 being pivotally connected by a piviot pin 202 carried by a bracket on the "I" beam 16. The other end of the belt crank 198 is provided with rollers 205 which are adapted to urge the log upwardly when the hydraulic cylinder 200 is actuated. This tends to disengage the log L from the saws 150.

Rearwardly of the rollers 205 is a continuous drag chain supported by a pair of longitudinally aligned sprockets 207 and 208. These sprockets 207 and 208 are respectively carried by transverse shafts 210 and 211 which are supported by pillow blocks such as pillow block 212 on the saw subframe 186. The rear transverse shaft 211 is driven, as will be explained hereinafter. The chain 206 is provided with outwardly protruding teeth 213 seen in FIG. 1B. These teeth 213 engage the cant and feed it rearwardly when the cant is dropped or released by the opposed dogs 94 and 140.

Aligned rearwardly of and respectively longitudinally with the saws 150 on the frames 160 are divider guards 215 which maintain in a separated condition, the portions of the log L which are cut from the log L to form the slabs or boards. Rearwardly of the divider guards 215 are the guard rails 216 which function to confine therebetween the cant in its travel, rearwardly. These guard rails 216 are disposed on opposite sides of the drag chain 206 and extend rearwardly therefrom, being supported by hinges 217 at their forward ends, the hinges 217 being pivotal about vertical axes and being connected to upright members (not shown). The rear portions of the guard rails 216 are biased inwardly by springs on lugs 218. These lugs 218, in turn, are supported by straps, such as strap 219, from the rear end portion of rail 24.

For delivering the slabs and the boards which are cut by the saws 150 from the opposite sides of the log L, there is provided a conveyor assembly having a pair of opposed, parallel, spaced, continuous conveyors, denoted generally by the numeral 220. The function of these conveyors 220 is to feed the boards onto the top take off conveyor 221 and the slabs to the bottom conveyor 222, selectively. For achieving this, the frame 223 of the conveyor assembly is hingedly mounted for pivoting about a transverse shaft 224 which is supported by pillow blocks 225 and standards, such as standard 226, extending upwardly from a cross bar 13. A continuous chain 227 from motor M6 drives the shaft 224 for driving the rollers, such as roller 230, for driving the spaced belts 231 which receive the slabs and the boards on both sides of the rails 216. The formal portions of belts 231 pass around idler rollers, such as idler roller 232 and 233. The frame, such as frame 223, is movable arcuately by a piston 234 and piston rod 235 which extend up from the base of the frame 10. The upper end of the piston rod 235 is connected to a cross bar 236 which supports both frames, such as frame 223, for simultaneous movement in an arcuate path upwardly and downwardly. When the piston 235 is retracted, the discharge end of the conveyors 220 are aligned with the conveyor 222 for discharging the slabs thereon. When the conveyors 220 are raised, however, they discharge to the conveyor 221. Furthermore, there is a central drag chain 240 which extends around the shaft 224 and is driven thereby which advances the cant, receiving it from the drag chain 206 with which the chain 240 is aligned along the centerline of the machine.

As best seen in FIG. 3, outward of the saws 150, respectively, and carried by the frames 160, respectively, are the board discharge conveyors denoted generally by the numerals 250. These discharge conveyors include a continuous belt 251 which pass over slide plates 252 and around rollers 253. A motor M-7 drives a belt 254, seen in FIG. 1B which, in turn, drives a drive wheel 255 which rotates the rear opposed pair of rollers 253, riding on the inside periphery of one of the rollers 253. This advances the upper flight of the belts 250 rearwardly for delivering the slabs from the vicinity of the saw 150 to the discharge conveyors 220. Immediately after the slabs and/or boards are severed from the log L, they fall onto the conveyors 250, and are fed rearwardly thereon onto the conveyors 220. The conveyors 220 are raised or lowered selectively, as described above for the discharge of the slabs or the lumber, as the case may be. The cant is dropped onto the drag chain 206 and thence is fed onto drag chain 240 for discharge as still an additional board onto conveyor 221 by the chain 240.

It will be obvious to those skilled in the art that many variations may be made in the embodiment here chosen for the purpose of illustrating the present invention, without departing from the scope thereof as defined by the appended claims.

We claim:

1. A sawmill of the type having a frame with a saw means for cutting slabs and boards from a log as it is reciprocated along a linear path, the log being suspended by dogs, wherein the improvement comprises:

(a) a pair of opposed parallel main rails disposed in a common horizontal plane and carried by said frame;

(b) a central monorail disposed parallel to and carried by said frame above and between said main rails;

(c) a main carriage having a main plate and wheels mounted for rotation on said plate, said wheels riding on said rails for supporting said main carriage for reciprocal movement longitudinally along said frame and for preventing appreciable pivoting or tilting of said plate;

(d) an auxiliary carriage having an auxiliary plate and a pair of wheels rotatably mounted for rotation on said plate and riding respectively on said rails for supporting an end portion of said auxiliary plate for movement longitudinally along said frame, said auxiliary carriage being rearwardly of said main carriage in said frame; said auxiliary carriage also having roller means supported by and riding on said monorail and spaced in a longitudinal direction from said pair of wheels for supporting another portion of said auxiliary plate; said wheels and said roller means preventing appreciable pivoting or tilting of said auxiliary plate;

(e) a pair of struts extending downwardly respectively from said main plate and said auxiliary plate for respectively supporting said dogs;

(f) control means connected between said main carriage and said auxiliary carriage for progressively altering the position of such carriages with respect to each other for moving said dogs into and out of clamping positions with respect to the ends of a log position between said dogs; and (g) drive means for driving one of the carriages with respect to said frame whereby said dogs move said log in a linear path past said saw means for cutting action of said saw means.

2. The sawmill defined in claim 1 wherein said monorail is an I-beam having a vertical web and a horizontally disposed lower flange and wherein said roller means rides on the upper surface of said lower flange.

3. The sawmill defined in claim 2 wherein said I-beam is disposed in a plane above the plane of said rails.

4. The sawmill defined in claim 2 wherein said roller means includes a pair of rollers disposed on opposite sides of said web, the flange of said I-beam being disposed above the plane of said main rails and means connecting said roll means to the upper surface of said auxiliary plate.

5. The sawmill defined in claim 4 wherein said roll means also includes a wheel disposed below said rollers and means on said monorail for preventing appreciable lateral movement of said auxiliary carriage.

6. The sawmill defined in claim 5 wherein said last mentioned means includes a V-shaped downwardly extending guide on the lower surface of said flange of said I-beam and wherein said wheel of said roller means has a V-shaped groove in the periphery thereof which engages said V-shaped guide along the upper periphery of said wheel of said roll means.

7. The sawmill defined in claim 1 wherein said drive means includes a drum mounted on said frame, cable means connected to said main carriage, said cable means extending around said drum, said cable means also extending rearwardly from said drum longitudinally over said frame, a pulley at the rear end of said of said frame and around which said cable means passes, the end portion of said cable means being connected to said main carriage.

8. The sawmill defined in claim 7 including upstanding brackets mounted on said main plate, and take-up bolts connected from said brackets to the portions of said cable means for forming the connection of said cable means to said main carriage.

9. The sawmill defined in claim 1 wherein said control means includes a cylinder connected to one of the carriages and a piston controlled by said cylinder, the end portion of said piston being connected to the other of said carriages, said piston being extendable and retractable for varying the distance between said main carriage and said auxiliary carriage.

10. The sawmill defined in claim 1 wherein said rails are opposed channel members having vertically disposed webs and horizontally disposed upper and lower flanges and wherein said rails face each other, the lower flanges of said rails being provided with upstanding lower guides and wherein said wheels are each provided with peripheral grooves, the lower peripheral portions of said wheels engaging said bottom flanges and the lower peripheral portion of said grooves receiving said guides.

11. The sawmill defined in claim 10 including upper guides on the lower surfaces of the upper flanges of said rails, guides receiving the upper peripheral portions of said grooves of said wheels.

12. The sawmill defined in claim 1 including a hydraulic motor connected to one of said dogs for rotating the same, hydraulic lines leading to said hydraulic motor, pivotal means connected to said hydraulic lines, pipes connected to said pivotal means, whereby said pivotal means pivot with respect to each other as said main carriage is moved along the length of said rails.

13. The sawmill defined in claim 1 including a log receiving and rotating assembly disposed in the front portion of said frame for supporting a log for being grasped between said dogs.

14. The sawmill defined in claim 13 wherein said assembly includes a pair of longitudinally extending rollers for receiving and supporting a log thereon within said frame, the axes of said longitudinally extending rollers being disposed in essentially horizontal, longitudinal, parallel, spaced relationship, means for simultaneously rotating said rollers, means for raising and lowering said rollers about their axes for rotating said leg thereon, and means between said rollers for lifting selectively one end or the other of said log or the other for centering the ends of said log for being clamped between said dogs.

15. The sawmill defined in claim 14 wherein said means for selectively lifting an end of said log includes a lever, transverse pivot means for pivotally mounting the central portion of said lever to said means for raising and lowering said rollers, a hydraulic cylinder for selectively tilting said lever in one direction or the other about said pivot means, whereby the end portions of said lever may be selectively extended between said rollers for engaging the lower surface of the end portion of the log disposed thereabove.

16. The apparatus defined in claim 1 wherein said saw means includes a pair of saws disposed with their axes in transverse alignment along the path of travel of said log, motor means for individually driving said saws and conveyor means disposed laterally outwardly of said saws for conveying the slabs and boards which are cut from said log by said saws, rearwardly of said frame.

17. The sawmill defined in claim 16 including means for tilting said conveyor means for selectively discharging said slabs and boards from said conveyor means at one height or another.

18. The sawmill defined in claim 1 including a cant conveyor for receiving the cant of said log after the boards have been cut therefrom and for conveying the cant rearwardly of said frame.

19. The sawmill defined in claim 18 including guides hingedly secured on opposite sides of the cant conveyor means for guiding said cant rearwardly of said machine.

* * * * *